US006544043B1

(12) United States Patent
Smith

(10) Patent No.: US 6,544,043 B1
(45) Date of Patent: Apr. 8, 2003

(54) ELECTRICAL CONNECTION MECHANISM FOR RESISTIVE GRIDDED REAR DROP GLASS

(75) Inventor: Ronald J Smith, Sterling Heights, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/083,741

(22) Filed: Feb. 27, 2002

(51) Int. Cl.[7] ..... H01R 33/00
(52) U.S. Cl. ..... 439/34; 219/203
(58) Field of Search ..... 439/34; 219/203

(56) References Cited

U.S. PATENT DOCUMENTS 3,981,556 A 9/1976 Sabatelli et al.
4,174,865 A 11/1979 Doveinis
4,244,774 A 1/1981 Dery
4,410,843 A * 10/1983 Sauer et al.
4,552,611 A 11/1985 Dery et al.
4,707,591 A * 11/1987 Sprenger
4,997,396 A 3/1991 Gold et al.
5,441,416 A * 8/1995 Gajewski et al. ..... 439/34
5,738,554 A * 4/1998 Borger et al. ..... 439/34
5,932,983 A 8/1999 Maue et al.
6,042,932 A 3/2000 Ingles et al.
6,320,159 B1 * 11/2001 Topp

* cited by examiner

*Primary Examiner*—Gary Paumen
(74) *Attorney, Agent, or Firm*—Laura C. Hargitt

(57) ABSTRACT

An electrical connection mechanism for the resistive grid of a motor vehicle drop glass, wherein an electrical connection is established only when a grid terminal, which is affixed to the drop glass, is in contact with a gate terminal, which is affixed to the tailgate. The gate terminal may optionally be located at a push switch, wherein the push switch, which is biased OFF, is switched ON when the grid terminal contacts and presses upon the gate terminal.

16 Claims, 5 Drawing Sheets

ELECTRICAL CONNECTION MECHANISM FOR RESISTIVE GRIDDED REAR DROP GLASS

TECHNICAL FIELD

The present invention relates to resistive gridded drop glass located at the rear of a motor vehicle, and more particularly to an electrical connection mechanism therefor.

BACKGROUND OF THE INVENTION

One problem associated with driving motor vehicles under adverse weather conditions relates to the potential for ice, snow and/or fog obscuring vision through the rear glass. One effective solution to this problem is the application of a resistive grid which, when electrically powered, serves to heat the glass and thereby cause ice, snow and/or fog to dissipate. Examples of resistive grid systems are found in U.S. Pat. Nos. 4,552,611 and 4,244,774.

An issue that arises with resistive grids is the wiring connection with respect to the motor vehicle electrical system. Generally, the resistive grid is composed of a plurality of horizontal heater bars connected to a vertical bus bar at either end thereof. The bus bars are each equipped with a connector for interfacing with the motor vehicle electrical system, one bus bar connecting to ground, the other to the positive voltage of the system. An example of an electrical connection for a hatchback type motor vehicle having a resistive gridded rear glass described in U.S. Pat. No. 4,997,396.

A problem which remains in the art of motor vehicle resistive gridded glass, is providing an electrical connection to the resistive grid of a rear drop glass (that is, a rear glass which moves up and down relative to the tailgate). In this regard, it would be most beneficial if somehow the electrical connection could be achieved without the necessity of flexing of a wiring harness in conformity with movements of the drop glass, and further, if somehow the power to the resistive grid could be available only when the drop glass is at the raised position (that is, prevented from being available when the drop glass is at the down position).

SUMMARY OF THE INVENTION

The present invention is an electrical connection mechanism for the resistive grid of a motor vehicle drop glass, wherein an electrical connection is established only when a grid terminal, which is affixed to the drop glass, is in contact with a gate terminal, which is affixed to the tailgate.

In a first form of the present invention, the grid terminal is located at a lower end comer of the drop glass and is electrically connected to a first buss bar of the resistive grid. The gate terminal is stationarily located inside the tailgate along a drop path of the grid terminal. In operation beginning with the drop glass at a lowered position, electrical contact between the gate terminal and the grid terminal occurs when the drop glass has moved upwardly sufficient that the grid terminal has physically slid contactingly onto the surface of the gate terminal, whereupon the resistive grid is powerable by the motor vehicle electrical system, subject to the operator engaging power thereto.

In a second form of the present invention, the gate terminal is located on a push switch which is connected to the tailgate. In operation beginning with the drop glass at a lowered position, electrical contact between the gate terminal and the grid terminal occurs when the drop glass has moved upwardly sufficient that the grid terminal has physically slid contactingly onto the surface of the gate terminal, as mentioned hereinabove. Now, however, as the grid terminal contacts the gate terminal, a lateral displacement causes the push switch (which is normally biased to OFF) to be switched ON, whereupon the resistive grid is powerable by the motor vehicle electrical system, subject to the operator engaging power thereto.

Accordingly, it is an object of the present invention to provide an electrical connection mechanism for connecting a resistive grid of a drop glass to a motor vehicle electrical system without the necessity of a flexible wiring harness which accommodates drop glass up and down movements.

It is an additional object of the present invention to provide an electrical connection mechanism for connecting a resistive grid of a drop glass to a motor vehicle electrical system without the necessity of a flexible wiring harness which accommodates drop glass up and down movements, wherein power is supplied to the resistive grid only when the drop glass is at the raised position.

These and additional objects, features and advantages of the present invention will become clearer from the following specification of a preferred embodiment.

DESCRIPTION OF THE PREFERRED EMBODIMENT

Figure 1:
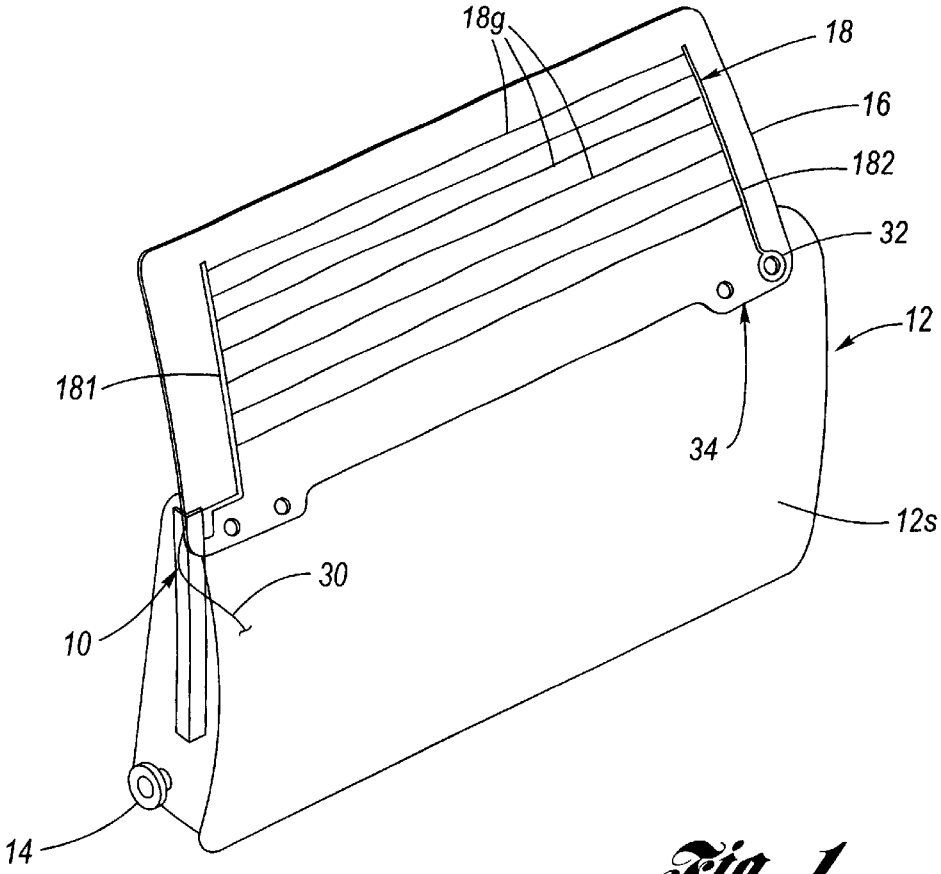
FIG. 1 is a perspective view of a first form of the electrical connection mechanism according to the present invention, seen in conjunction with a gridded drop glass and tailgate.
Figure 2:
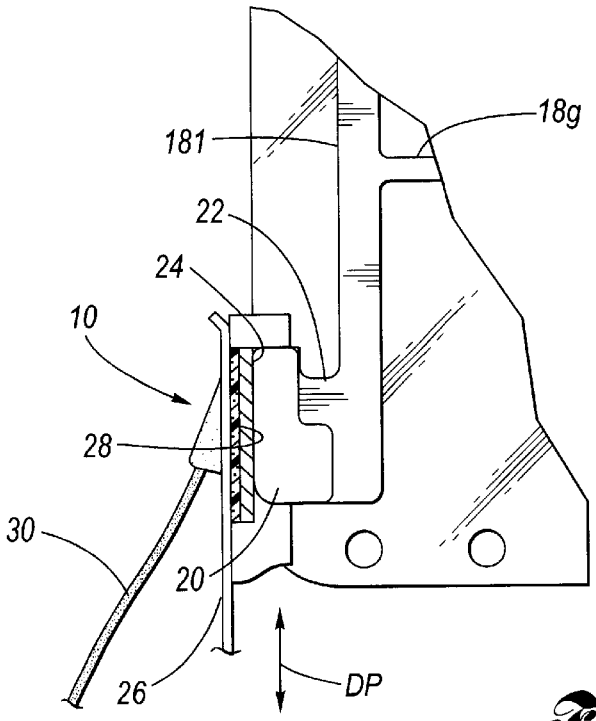
FIG. 2 is a detail, partly sectional side view of the first form of the electrical connection mechanism as seen at FIG. 1, wherein the drop glass is at the fully raised position.
Figure 3:
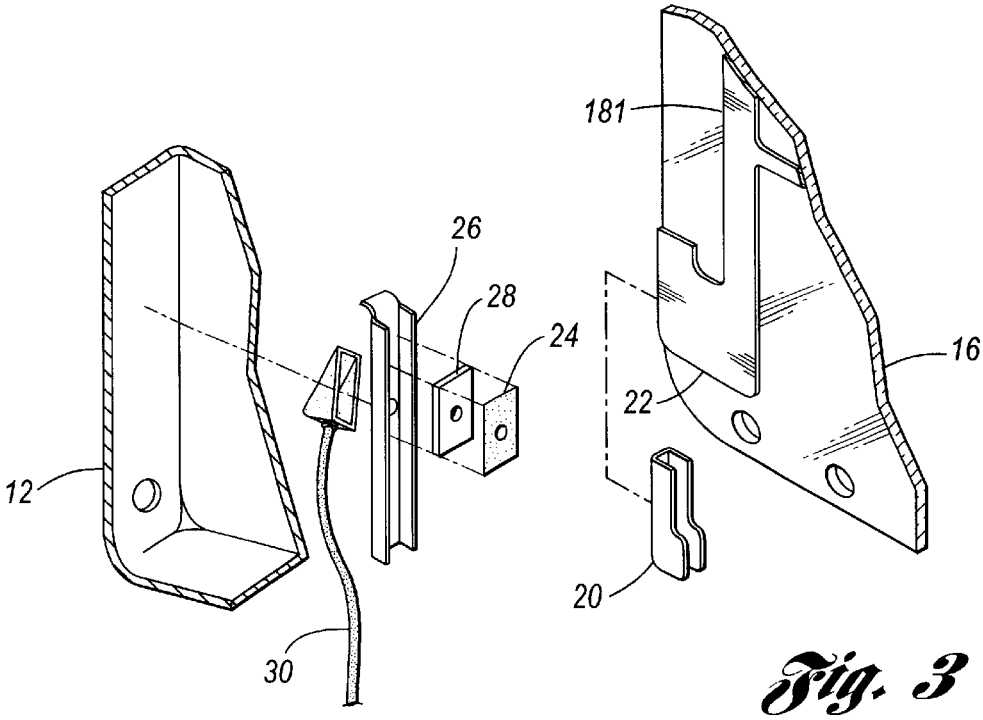
FIG. 3 is an exploded view of the first form of the electrical connection mechanism, as seen at FIG. 1.

Referring now to the Drawing, FIGS. 1 and 2 depict an example of operation of the electrical connection mechanism 10 according to a first form of the present invention. In this regard, a tailgate 12 is pivotally connected on a pivot 14 to the rear of a motor vehicle (not shown), wherein a drop glass 16 thereof is operable between a fully raised position (as shown at FIG. 1) and a fully lowered position whereat the drop glass is located within the skin 12*s* of the tailgate. The drop glass 16 is operable between the fully raised and fully lowered positions via a regulator mechanism, as for example described in U.S. Pat. No. 4,174,865. The drop glass is provided with a resistive grid 18 having a first buss bar 181 and a second buss bar 182. When electrical power from the motor vehicle electrical system is provided to the resistive grid 18, the plurality of generally parallel and horizontal grid bars 18g thereof are caused to heat, thereby locally heating the drop glass 16 with the consequence that fog, ice, snow, etc. are dissipated from the surface of the drop glass. Power is supplied from the motor vehicle electrical system to the resistive grid 18 via the electrical connection system according to the present invention.

Figure 4:
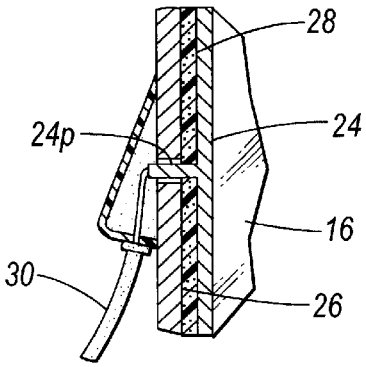
FIG. 4 is a detail, partly sectional side view of an affixment modality for the gate terminal the first form of the electrical connection mechanism according the present invention.

A grid terminal 20 is affixed to a lower end corner of the drop glass which is electrically connected, via a buss bar extension 22, to the first buss bar 181 of the resistive grid 18. A preferred form of grid terminal 20 is a U-shaped metallic shoe. A gate terminal 24 is stationarily located inside the tailgate 12 along the drop path DP of the grid terminal 20 as the drop glass moves up or down relative to the tailgate skin 12*s*. In a first mode (shown at FIGS. 1 through 5), the gate terminal 24 is affixed to the drop glass run channel 26 and insulated therefrom via an insulated pad 28. A pigtail connector 30 is connected at one end to the motor vehicle electrical system and at the other end to the gate terminal 24 via, for example, a pin 24*p* of the gate terminal (see FIG. 4).

The second buss bar 182 of the resistive grid 18 is connected to ground of the motor vehicle electrical system. One modality for accomplishing this connection is shown at FIG. 1, wherein a washer terminal 32 is electrically connected to the second buss bar 182 and to the drop glass 16 at a mounting feature 34. The mounting feature 34 connects to the aforementioned regulator mechanism, which is, in turn, connected to ground.

Figure 5:
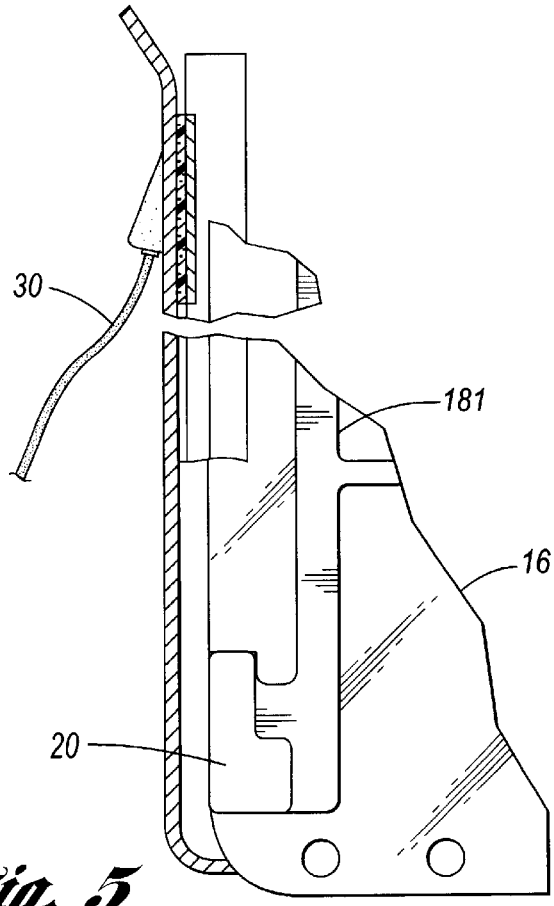
FIG. 5 is a side view of the first form of the electrical connection mechanism according to the present invention, wherein the drop glass is in the fully lowered position.

In operation beginning with the drop glass 16 at the fully lowered position, as shown at FIG. 5, electrical contact between the gate terminal 24 and the grid terminal 20 is absent because the gate terminal is vertically separated from the grid terminal. Accordingly, the resistive grid cannot be powered, accidentally or intentionally. When the operator actuates the drop glass regulator so as to raise the drop glass to the fully raised position, as shown at FIGS. 1 and 2, the grid terminal 20 comes into sliding direct contact with the gate terminal 24, whereupon the resistive grid is powerable by the motor vehicle electrical system, subject to the operator engaging the power thereto.

Figure 6:
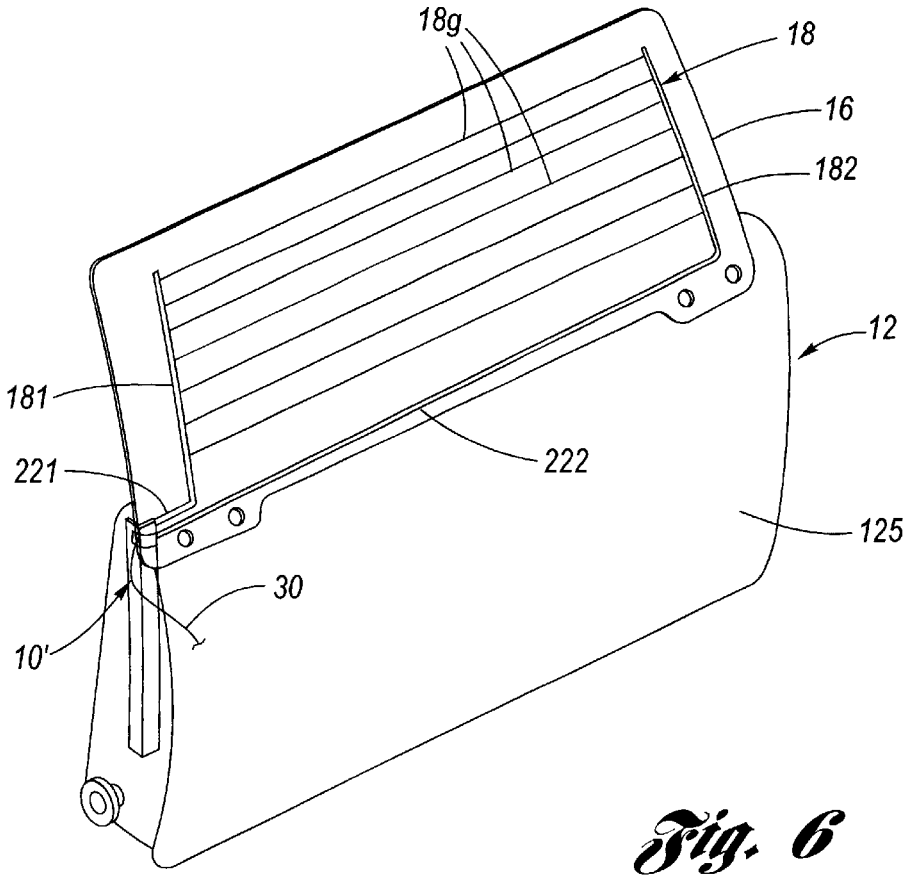
FIG. 6 is a perspective view as in FIG. 1, showing an alternative first form of the electrical connection mechanism which includes a ground connection.
Figure 7:
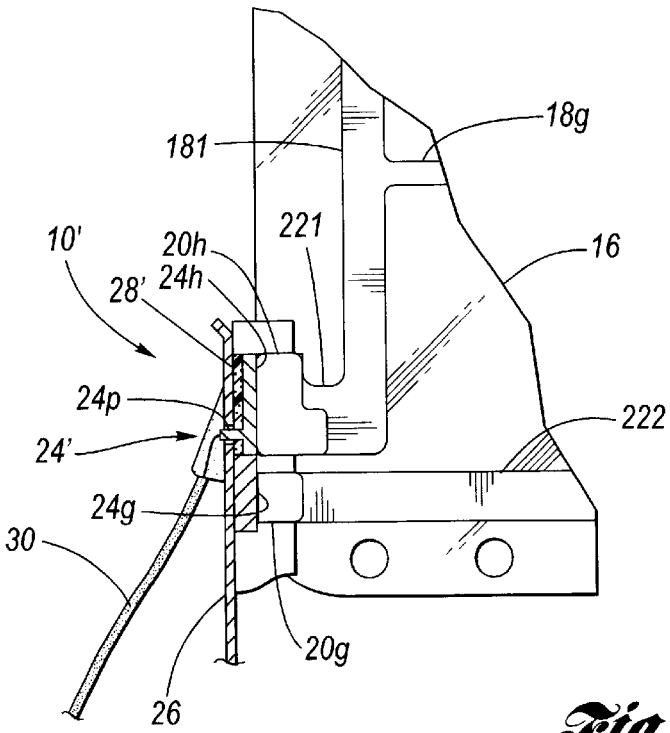
FIG. 7 is a detail, partly sectional side view of the alternative first form of the electrical connection mechanism as seen in FIG. 6, wherein the drop glass is in the fully raised position.

An alternative of the first form of the electrical connection mechanism 10' is depicted at FIGS. 6 and 7, wherein a second modality for connecting the second buss bar 182 to ground is depicted, and wherein parts identical to those of FIGS. 1 and 2 have identical numbers, whereby a further description thereof is obviated.

The gate terminal 24' is now divided into two components: a hot gate terminal 24*h* and a ground gate terminal 24*g*. The hot gate terminal 24*h* is separated from the run channel 26 by an insulated pad 28', wherein a pin 24*p* passes therethrough and through the run channel to a connection with the pigtail 30. The ground gate terminal is directly connected to the run channel 26 which is, itself, connected to ground. The first buss bar 181 connects to a first buss bar extension 221, and the second buss bar 182 connects to a second buss bar extension 222. A hot grid terminal 20*h*, preferably in the form of a U-shaped metallic shoe, is connected to the drop glass 16 at the first buss bar extension 221, while separated therefrom is a ground grid terminal 20*g* which is connected to the drop glass at the second buss bar extension 222. In operation, the hot and ground gate terminals 24*h*,24*g* are located on the drop path of the hot and ground grid terminals 20*h*,20*g* such that when the drop glass 16 is at the fully raised position, the positive voltage from the hot gate terminal connects contactingly to the hot grid terminal and the ground voltage of the ground gate terminal connects contactingly to the ground grid terminal, each connection being independent of the other.

Figure 8:
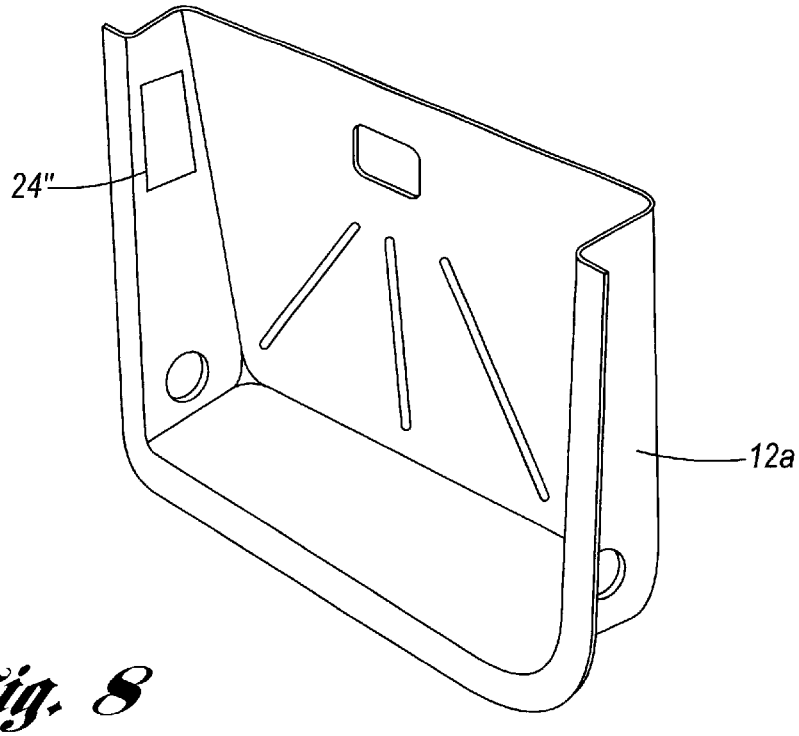
FIG. 8 is a perspective view of an alternative affixment modality for the gate terminal of the first form of the electrical connection mechanism according to the present invention.

FIG. 8 depicts an alternative modality for connection of the gate terminal 24" of the first form of the electrical connection mechanism, whereby the gate terminal is connected onto an insulating pad which is, in turn, connected directly to the tailgate skin 12*a*.

Figure 9:
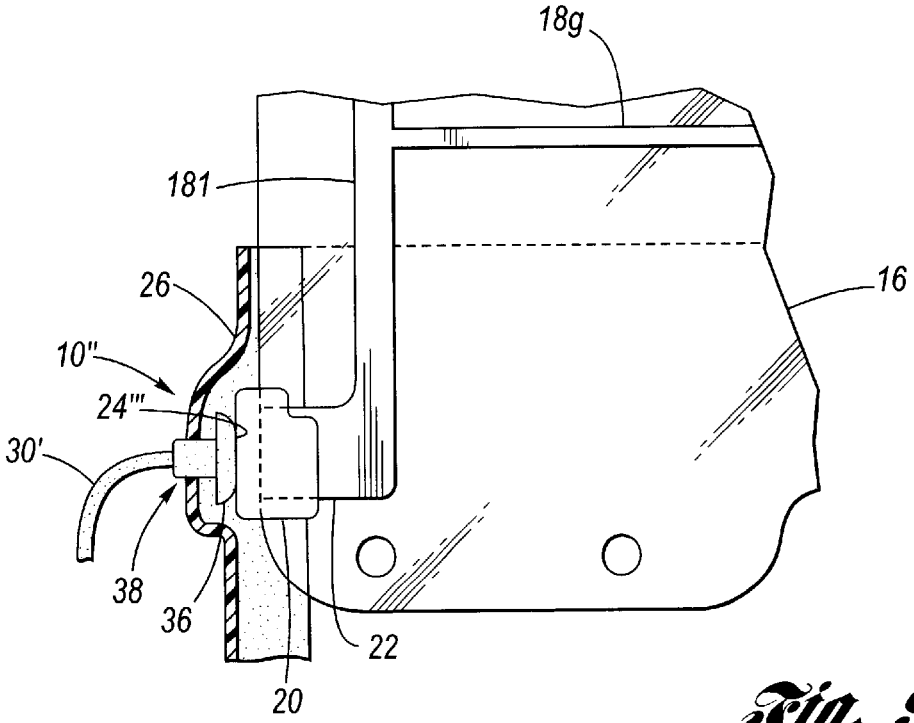
FIG. 9 is a detail, partly sectional side view of a second form of the electrical connection mechanism according to the present invention, wherein the drop glass is at the fully raised position.

Turning attention now to FIGS. 9 though 10B a second form of the electrical connection mechanism 10" will be described, wherein the drop glass 16, the resistive grid 18 and the grid terminal 20 are as recounted hereinabove. Now, however, the gate terminal 24'" is located on the head 36 of a push switch 38, wherein the body of the push switch is connected to the tailgate. The push switch 38 is normally OFF via internal spring biasing (see FIGS. 10A and 10B). When the head 36 is depressed, the head makes electrical contact with the pigtail 30', and because the gate terminal 24'" is electrically connected with the head (ie., the gate terminal is connected in series with the switch), the gate terminal is now electrically connected to the pigtail.

Figure 10A:
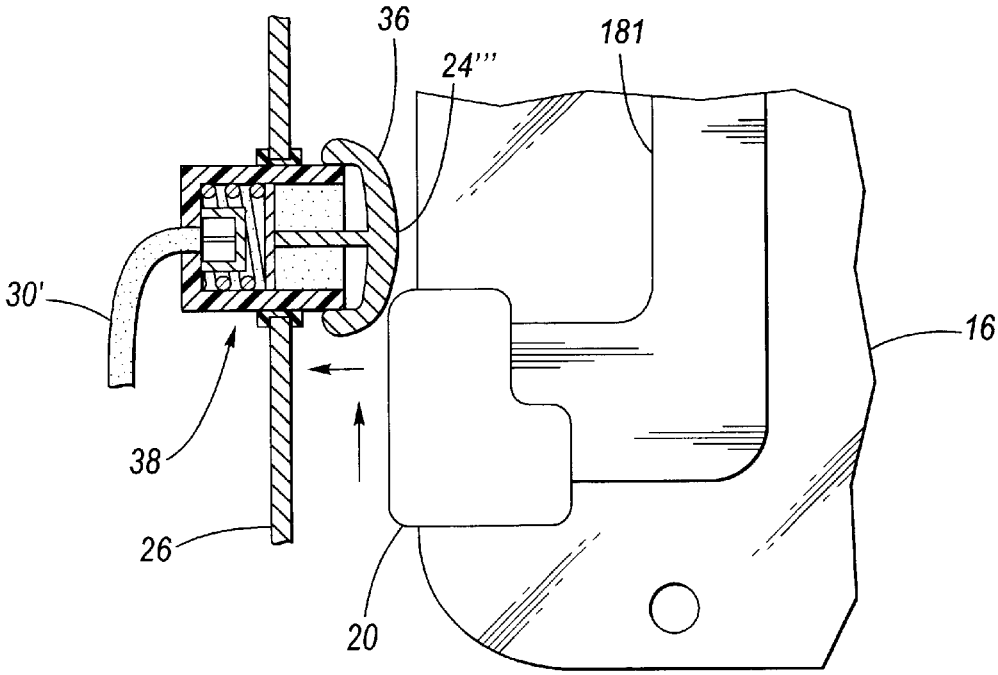
FIG. 10A is a detail, partly sectional side view of a second form of the electrical connection mechanism according to the present invention, wherein the drop glass is approaching the fully raised position.
Figure 10B:
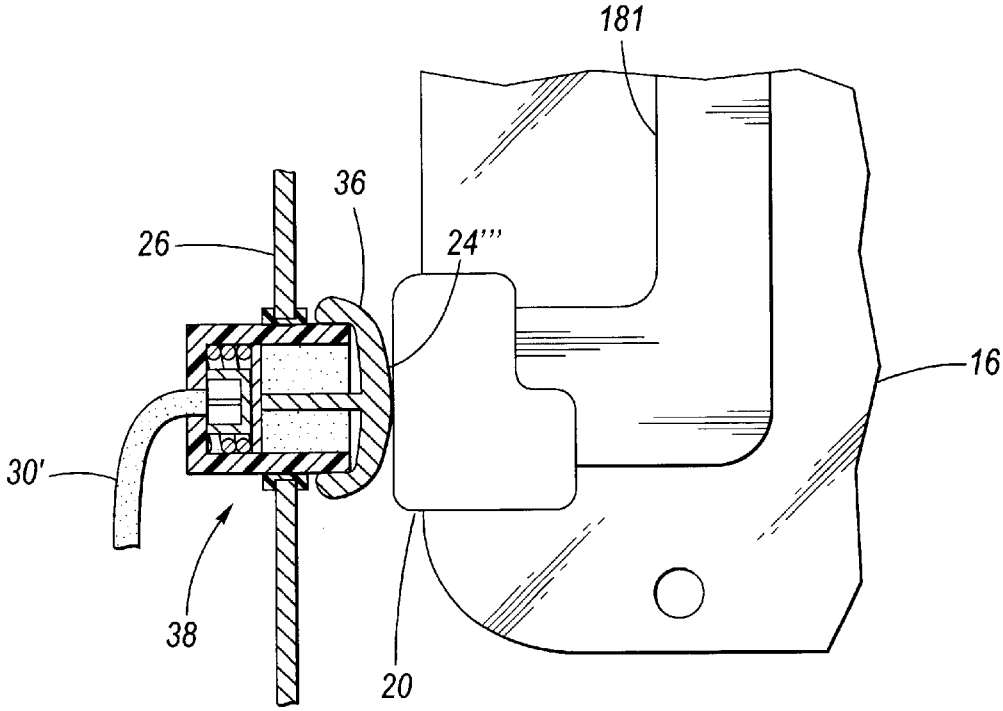
FIG. 10B is a detail, partly sectional side view of a second form of the electrical connection mechanism according to the present invention, wherein the drop glass is at the fully raised position.

In operation, as the drop glass raises to the fully raised position, the grid terminal 20 begins to press upon the head 36, as shown at FIG. 10A. When the drop glass achieves the fully raised position, the head is depressed sufficiently that now the push switch 38 is turned ON and power from the pigtail 30' (subject to the operator's engaging power thereto) is connected to the resistive grid 18 via contacting of the surfaces of the grid and gate terminals 20, 24'".

Based upon the foregoing disclosure, it will be recognized that ground can be provided via the electrical connection mechanism 10" for example by using the aforedescribed washer terminal of FIG. 1 or via contact of a ground gate terminal contact with a ground grid terminal of FIG. 9, wherein the ground gate terminal is located along the drop path in spaced relation from the push button.

It is to be understood that the electrical connection mechanism according to the present invention may provide an electrical connection to the resistive grid either only when the drop glass is in the fully raised position or, alternatively, at any position between the fully raised and fully lowered positions, simply by proper elongation of the gate terminal along the drop path.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A gridded drop glass and electrical connection mechanism therefor, the motor vehicle having an electrical system, comprising:

a drop glass movable between a fully raised position and a fully lowered position;

a resistive grid connected with said drop glass, said resistive grid having first and second electrical connections;

a grid terminal connected to said drop glass and to said first electrical connection, wherein as said drop glass moves between said fully raised and fully lowered positions said grid terminal moves along a drop path; and a gate terminal located at a fixed position on said drop path;

wherein at a predetermined position of said drop glass, said grid terminal is in electrical contact with said gate terminal such that an electrical interface with the motor vehicle electrical system is provided to said resistive grid through said gate and grid terminals.

2. The gridded drop glass and electrical connection mechanism therefor of claim 1, wherein said grid terminal comprises a U-shaped metallic shoe located at a lower corner of said drop glass.

3. The gridded drop glass and electrical connection mechanism therefor of claim 1, wherein said grid terminal only contacts said gate terminal when said drop glass is substantially at said fully raised position.

4. The gridded drop glass and electrical connection mechanism therefor of claim 1, further comprising a ground connection to said second electrical connection.

5. The gridded drop glass and electrical connection mechanism therefor of claim 4, wherein said ground connection comprises:

a ground gate terminal located at a fixed position on said drop path in spaced relation from said gate terminal;

a ground grid terminal connected to said drop glass in spaced relation from said grid terminal and connected to said second electrical connection, wherein as said drop glass moves between said fully raised and fully lowered positions said ground grid terminal moves along said drop path;

wherein at the predetermined position of said drop glass, said ground grid terminal is in electrical contact with said ground gate terminal such that a second electrical interface with the motor vehicle electrical system is provided to said resistive grid through said ground gate terminal and said ground grid terminal.

6. The gridded drop glass and electrical connection mechanism therefor of claim 5, wherein said grid terminal comprises a U-shaped metallic shoe located at a lower corner of said drop glass.

7. The gridded drop glass and electrical connection mechanism therefor of claim 5, wherein said grid terminal only contacts said gate terminal and said ground grid terminal only contacts said ground gate terminal when said drop glass is substantially at said fully raised position.

8. A gridded drop glass and electrical connection mechanism therefor, the motor vehicle having an electrical system, comprising:

a drop glass movable between a fully raised position and a fully lowered position;

a resistive grid connected with said drop glass, said resistive grid having first and second electrical connections;

a grid terminal connected to said drop glass and to said first electrical connection, wherein as said drop glass moves between said fully raised and fully lowered positions said grid terminal moves along a drop path;

a gate terminal located adjacent said drop path; and a switch electrically connected in series with said gate terminal; and wherein at a predetermined position of said drop glass, said grid terminal is in electrical contact with said gate terminal and said switch is switched ON such that an electrical interface with the motor vehicle electrical system is provided to said resistive grid through said gate and grid terminals.

9. The gridded drop glass and electrical connection mechanism therefor of claim 8, wherein said switch comprises a push switch located at a fixed position adjacent said drop path, said push switch having a switch body and head movable with respect to said body, said push switch being normally biased OFF and being switched ON by movement of said head in a direction opposite said biasing, said gate terminal being located on said head;

wherein at the predetermined position of said drop glass, said grid terminal is in electrical contact with said gate terminal and moves said head so as to switch ON said push switch such that an electrical interface with the motor vehicle electrical system is provided to said resistive grid through said gate and grid terminals.

10. The gridded drop glass and electrical connection mechanism therefor of claim 8, wherein said grid terminal comprises a U-shaped metallic shoe located at a lower corner of said drop glass.

11. The gridded drop glass and electrical connection mechanism therefor of claim 8, wherein said grid terminal only contacts said gate terminal when said drop glass is substantially at said fully raised position.

12. The gridded drop glass and electrical connection mechanism therefor of claim 8, further comprising a ground connection to said second electrical connection.

13. The gridded drop glass and electrical connection mechanism therefor of claim 12, wherein said ground connection comprises:

a ground gate terminal located at a fixed position on said drop path in spaced relation from said gate terminal;

a ground grid terminal connected to said drop glass in spaced relation from said grid terminal and connected to said second electrical connection, wherein as said drop glass moves between said fully raised and fully lowered positions said ground grid terminal moves along said drop path;

wherein at the predetermined position of said drop glass, said ground grid terminal is in electrical contact with said ground gate terminal such that a second electrical interface with the motor vehicle electrical system is provided to said resistive grid through said ground gate terminal and said ground grid terminal.

14. The gridded drop glass and electrical connection mechanism therefor of claim 13, wherein said switch comprises a push switch located at a fixed position adjacent said drop path, said push switch having a switch body and head movable with respect to said body, said push switch being normally biased OFF and being switched ON by movement of said head in a direction opposite said biasing, said gate terminal being located on said head;

wherein at the predetermined position of said drop glass, said grid terminal is in electrical contact with said gate terminal and moves said head so as to switch ON said push switch such that an electrical interface with the motor vehicle electrical system is provided to said resistive grid through said gate and grid terminals.

15. The gridded drop glass and electrical connection mechanism therefor of claim 14, wherein said grid terminal comprises a U-shaped metallic shoe located at a lower corner of said drop glass.

16. The gridded drop glass and electrical connection mechanism therefor of claim 14, wherein said grid terminal only contacts said grid terminal when said drop glass is substantially at said fully raised position.

* * * * *